US007591162B2

(12) United States Patent
Meyer

(10) Patent No.: US 7,591,162 B2
(45) Date of Patent: Sep. 22, 2009

(54) PROTECTIVE GUIDE ASSEMBLY FOR A ROLL FORMING MACHINE

(75) Inventor: Bruce E. Meyer, Port Charlotte, FL (US)

(73) Assignee: Englert, Inc., Perth Amboy, NJ (US)

( * ) Notice: Subject to any disclaimer, the term of this patent is extended or adjusted under 35 U.S.C. 154(b) by 917 days.

(21) Appl. No.: 11/188,369

(22) Filed: Jul. 25, 2005

(65) Prior Publication Data

US 2007/0039368 A1 Feb. 22, 2007

(51) Int. Cl.
*B21D 5/08* (2006.01)

(52) U.S. Cl. ..... 72/176; 72/181; 72/428

(58) Field of Classification Search ..... 72/168, 72/176, 177, 179, 181, 182, 250, 251, 428
See application file for complete search history.

(56) References Cited

U.S. PATENT DOCUMENTS

| | | | | |
|---|---|---|---|---|
| 4,039,063 | A * | 8/1977 | Knudson | 193/35 R |
| 4,656,858 | A * | 4/1987 | Addison | 72/181 |
| 5,394,722 | A * | 3/1995 | Meyer | 72/129 |
| 5,551,272 | A * | 9/1996 | Knudson | 72/181 |
| 6,351,978 | B1 * | 3/2002 | Kusakabe et al. | 72/52 |
| 6,772,616 | B2 * | 8/2004 | Cunningham et al. | 72/181 |

* cited by examiner

*Primary Examiner*—Edward Tolan
(74) *Attorney, Agent, or Firm*—David L. Davis

(57) ABSTRACT

A roll forming machine for forming a rain gutter wherein an internal guide assembly uses rollers to contact the finished surface of the partially formed gutter.

4 Claims, 5 Drawing Sheets

PROTECTIVE GUIDE ASSEMBLY FOR A ROLL FORMING MACHINE

BACKGROUND OF THE INVENTION

This invention relates to roll forming machines and, more particularly, to a roll forming machine for producing a rain gutter and which includes an internal gutter guide assembly which is protective of the finish on the face of the gutter.

Roll forming machines for producing rain gutters are generally well known. In such a machine, the gutters are formed from a supply coil of sheet metal which is finished on a first side so that the exterior of the finished gutter has an aesthetically pleasing appearance. As the sheet metal is driven through the machine along a predetermined path of travel, its lateral profile is gradually transformed from a flat sheet into a downwardly concave trough having a desired lateral profile and with the finished side of the sheet metal forming the exterior surface of the trough. During this transformation, the outside of the partially formed gutter is contacted by guide structure to ensure that it moves properly through sets of series of roll forming stations. Up to now, the present face guide design includes a fixed face guide rod, which allowed one to raise the leading edge of the sheet metal as the material is fed through the machine from one set of roll forming stations to the next set of roll forming stations. When both sets of roll forming stations fully engage the sheet metal, the gutter profile being formed will lift up off the face guide rod by approximately up to ⅛" so that the guide rod does not scratch the surface of the gutter. This works fine for a short span between the sets of roll forming stations because there is enough structural integrity in the gutter profile to maintain a gap between the profile and the guide rod. However, in a machine which has a large span between sets of roll forming stations, the gutter, profile cannot maintain a gap between the gutter profile and the fixed face guide rod. The gutter would simply flex enough over the large span that it would be impossible to maintain a gap between the gutter profile and the face guide rod without putting a permanent detrimental set into the gutter profile itself. Thus, the face of the gutter would scrape along the face guide rod, leading to scratching of the face of the gutter and creating an unsightly appearance. It would therefore be desirable to provide guide structure which allows the gutter face to remain in line with the pass line of the roll forming tool sets without scratching the gutter's finished face.

SUMMARY OF THE INVENTION

The present invention finds utility in a roll forming machine of the type which forms an indeterminate length panel having a desired lateral profile from a uniform width supply strip of sheet metal having a pair of parallel straight edges. The roll forming machine drives the supply strip along a predetermined path of travel through a series of spaced roll forming stations. The supply strip has a first side which is finished to provide an aesthetically pleasing appearance. The invention includes an assembly for contacting the finished first side of the supply strip to guide a partially formed portion of the panel along a portion of the predetermined path of travel without marring the finished first side. The inventive guide assembly comprises an elongated rod mounted to a frame of the machine and extending substantially parallel to the portion of the predetermined path of travel, at least one holder mounted to the rod, and at least one roller each mounted to a respective one of the at least one holder for rotation about a respective axis orthogonal to the rod.

In accordance with an aspect of this invention, the at least one holder is rotatably mounted to the rod.

In accordance with another aspect of this invention, the at least one holder is slidably mounted to the rod.

In accordance with another aspect of this invention, the at least one roller has a cylindrical shape.

BRIEF DESCRIPTION OF THE DRAWINGS

The foregoing will be more readily apparent upon reading the following description in conjunction with the drawings in which like elements in different figures are identified by the same reference numeral and wherein.

DETAILED DESCRIPTION

Figure 1:
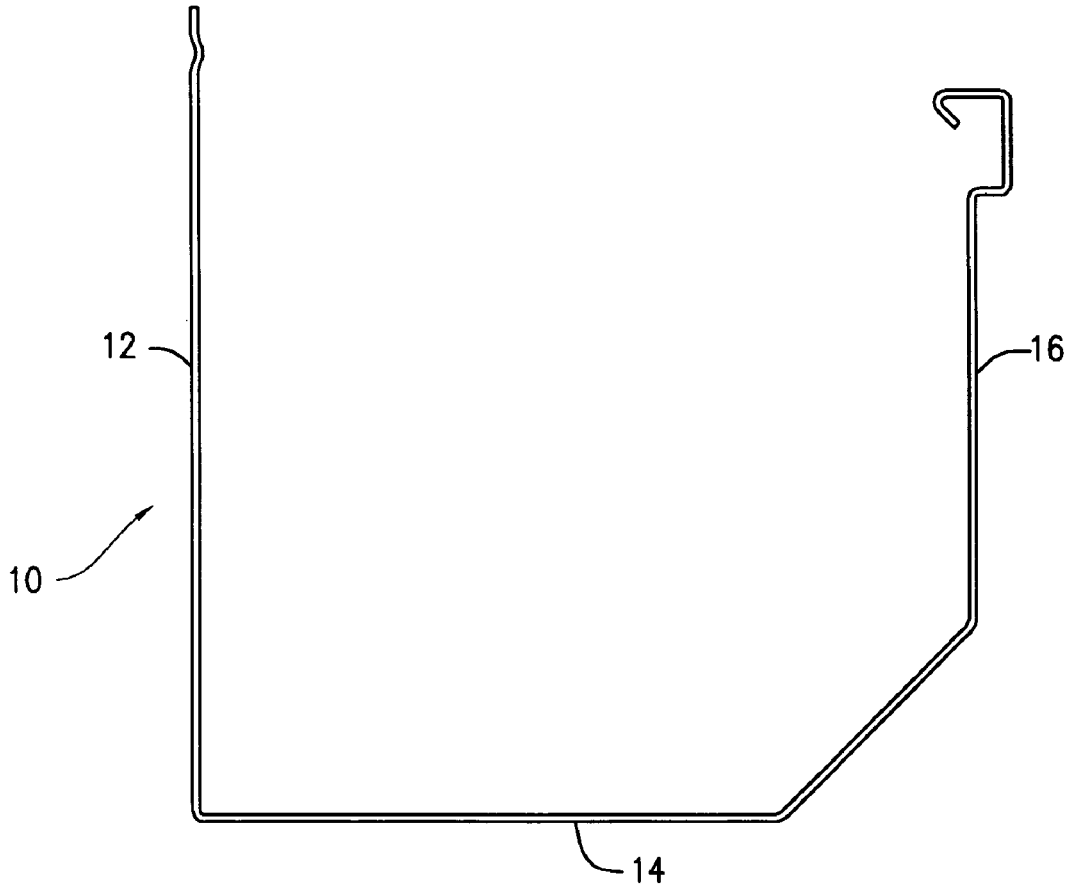
FIG. 1 shows an exemplary rain gutter lateral profile which can be produced by a roll forming machine incorporating the present invention.

Referring to the drawings, FIG. 1 shows the profile of an exemplary rain gutter, designated generally by the reference numeral 10, which can be produced by a roll forming machine incorporating structure embodying the present invention. The gutter 10 is generally in the form of a downwardly concave trough having a back wall 12, a lower wall 14 and a face wall 16. As is the general practice in the art, the back wall 12 is designed to abut supporting structure on a building to which the gutter 10 is attached, and therefore cannot be seen by an observer. However, the face wall 16 is designed to be visible from outside the building and therefore it is desired that the exterior surface of the face wall 16 be finished to provide an aesthetically pleasing appearance.

Figure 2:
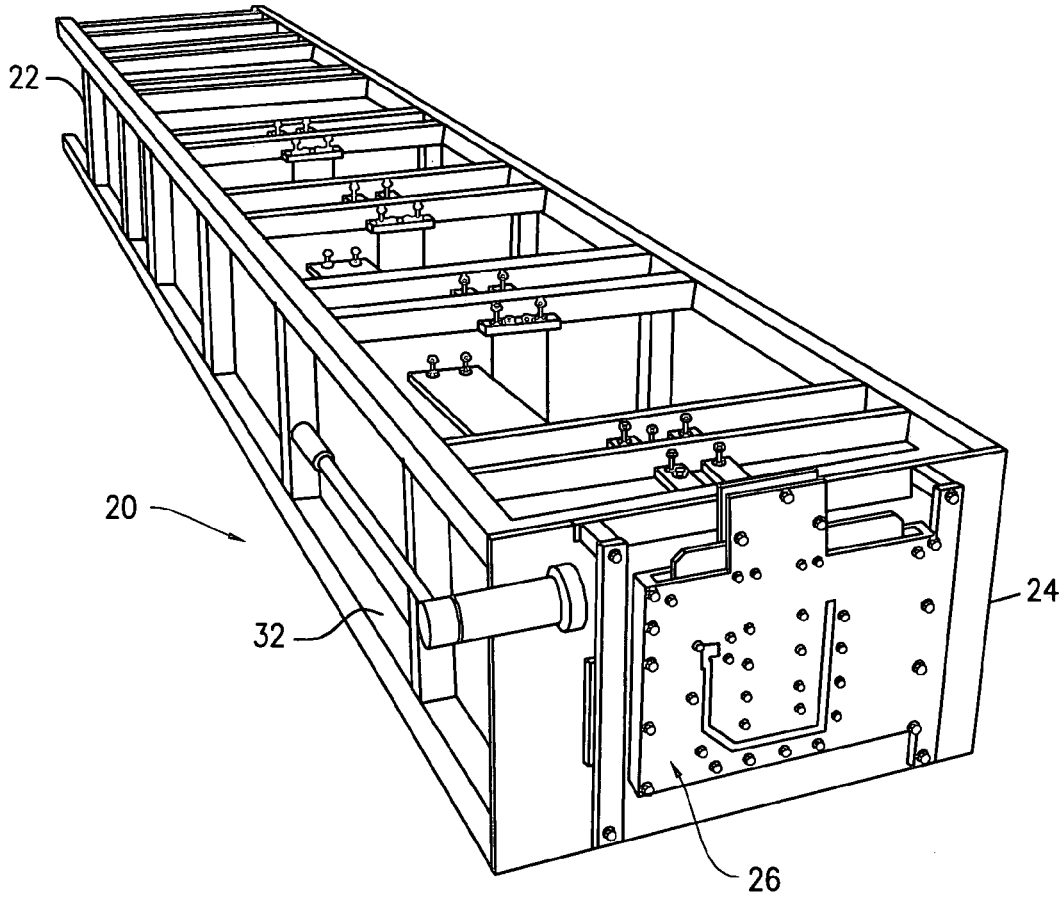
FIG. 2 is a perspective view of an exemplary roll forming machine in which structure constructed according to the present invention may be incorporated.

FIG. 2 shows a roll forming machine, designated generally by the reference numeral 20, which may be used for forming the gutter 10. As is conventional, the machine 20 has a spindle (not shown) near its entry end 22 for supporting a supply coil of sheet metal (not shown). The sheet metal supply coil is of uniform width and has a pair of parallel straight edges. The sheet metal is finished, as by painting for example, on one side so that the exterior surface of the formed gutter 10 is finished. As is known in the roll forming art, the supply coil is pulled by driven rollers so as to travel through the machine 20 along a predetermined path past a plurality of spaced roll forming stations. At the exit end 24 of the machine 20 is a cutting station 26 for cutting the formed gutter to a desired length. The foregoing is well known in the art of roll forming and does not form a part of the present invention.

As the supply coil is pulled through the machine 20, each successive roll forming station operates to gradually transform the lateral profile of the sheet metal from a flat sheet to the profile shown in FIG. 1. Thus, the sheet metal starts as a flat sheet with its finished side on the bottom and gradually assumes a downwardly concave trough-like shape with its finished side on the outside of the gutter. During this transformation, it is usual to provide guide structure along a portion of the predetermined path of the partially formed gutter to guide the partially formed gutter properly through a series of spaced roll forming stations. This guide structure contacts the finished (outside) surface of the gutter, and therefore it is desirable that the guide structure be protective of the surface finish.

Figure 3:
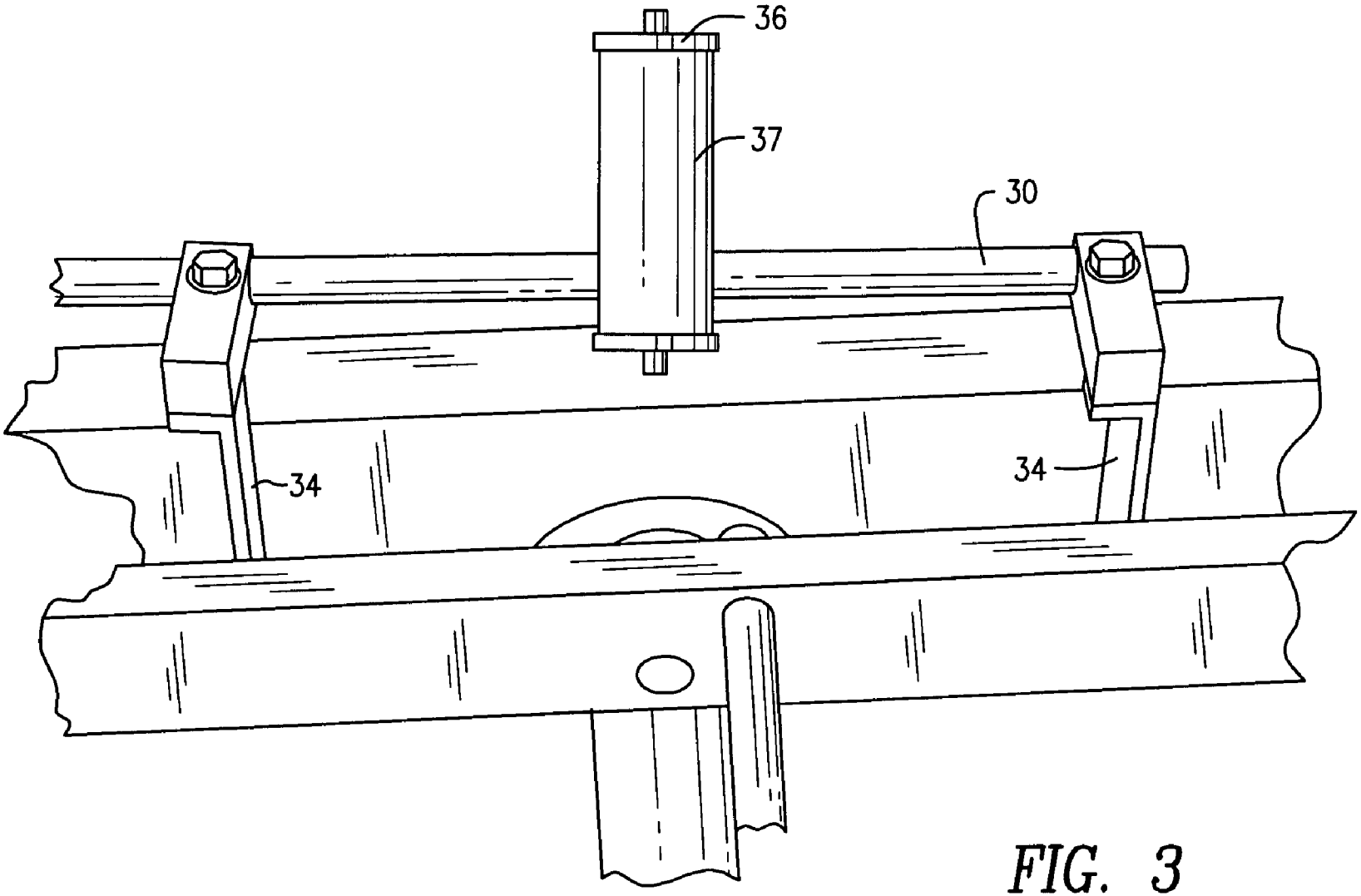
FIG. 3 illustrates a portion of exemplary guide structure according to the present invention.
Figure 4:
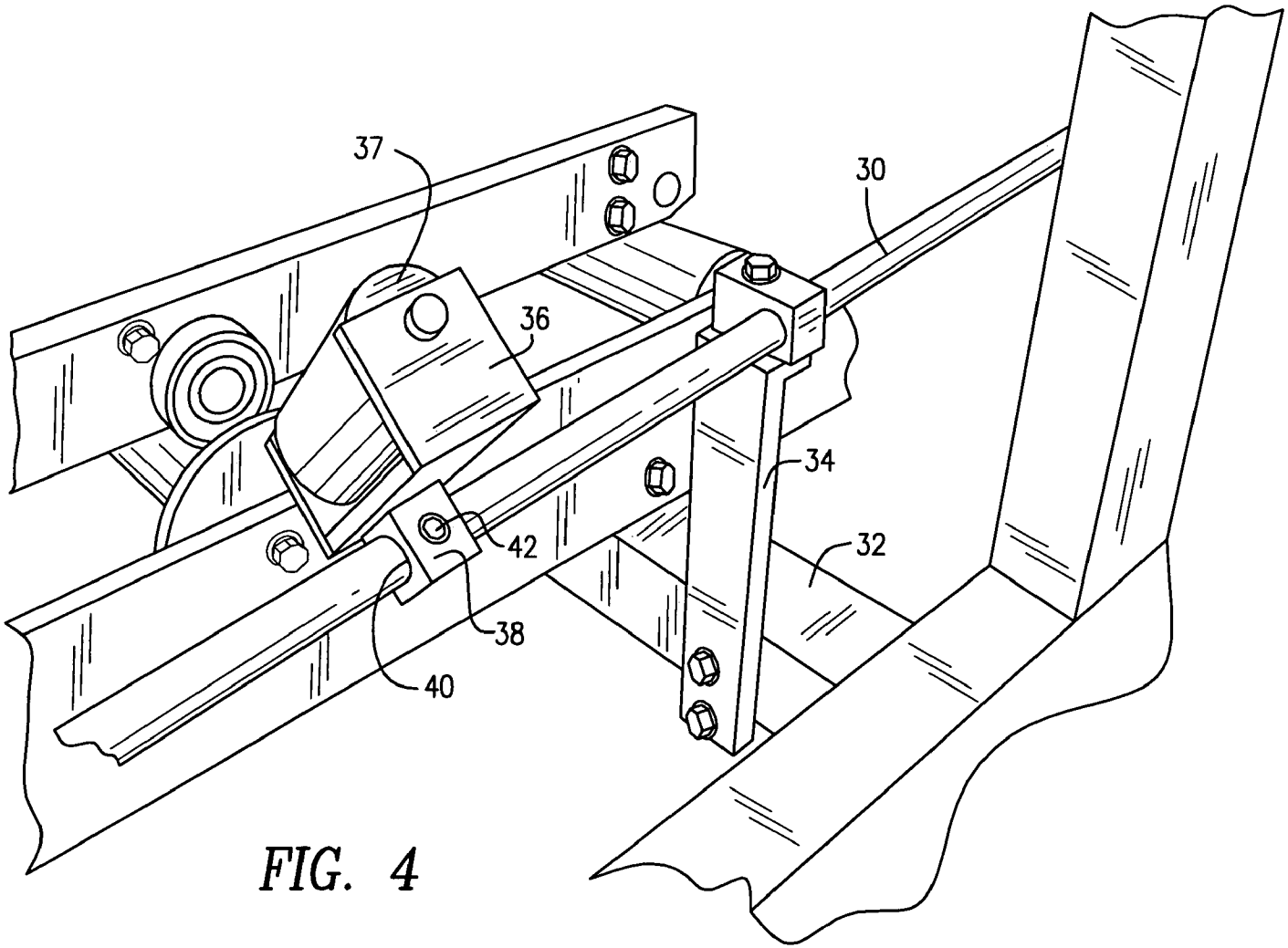
FIG. 4 is another view of a portion of the exemplary guide structure shown in FIG. 3.
Figure 5:
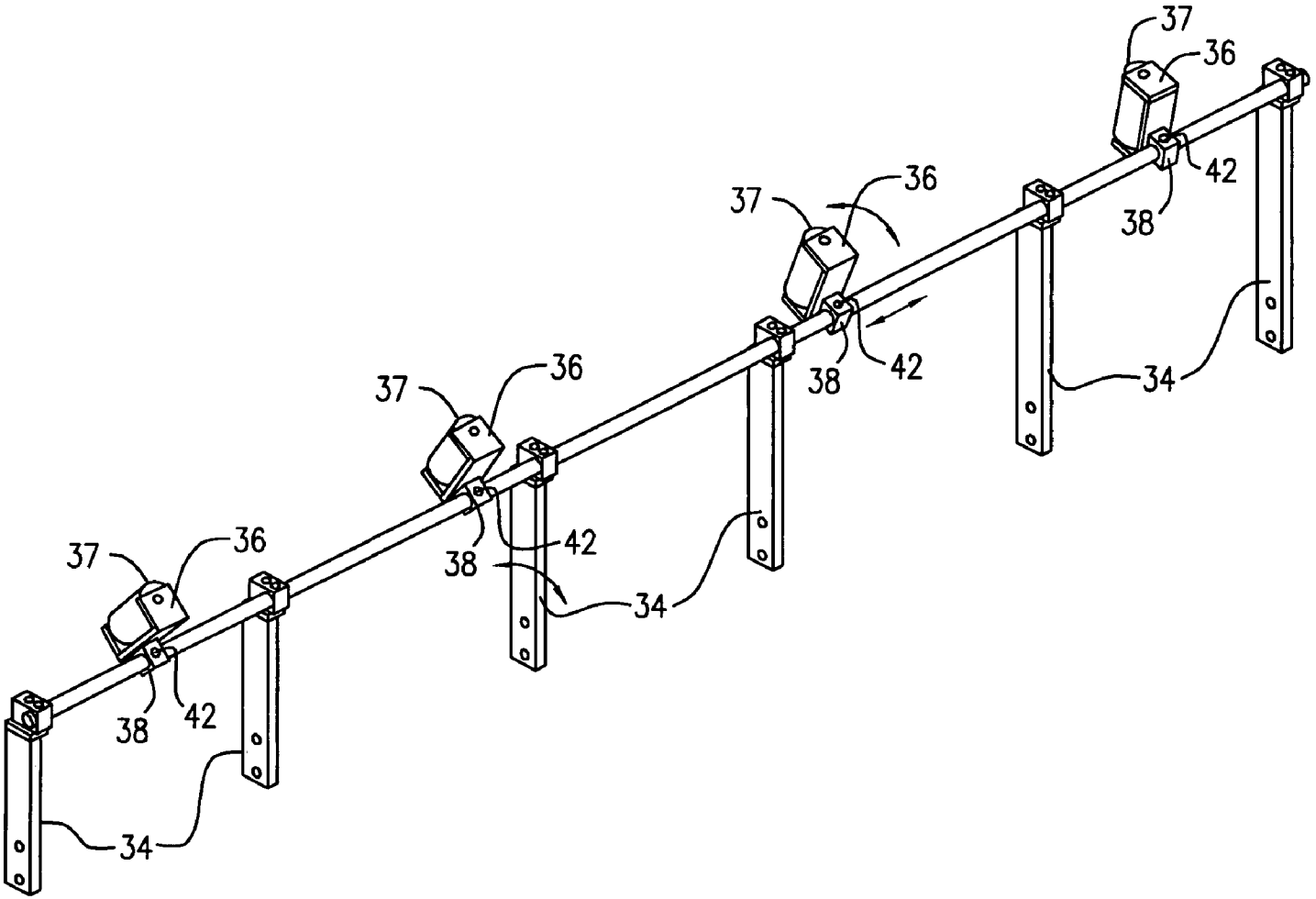
FIG. 5 schematically illustrates the entire exemplary guide structure shown partially in FIGS. 3 and 4.

Referring to FIGS. 3, 4 and 5, the inventive guide assembly includes an elongated rod 30 mounted to the frame 32 of the machine 20 by a series of posts 34 bolted to the frame 32. The rod 30 extends substantially parallel to the aforementioned portion of the predetermined path of travel of the partially formed gutter. At least one holder 36 is mounted to the rod 30 and a respective cylindrical roller 37 is mounted to each holder 36 for rotation about a respective axis orthogonal to the rod 30. Each holder 36 has a respective mounting block 38 secured thereto, as by welding or the like. Each mounting block 38 is formed with a through-bore 40 sized to accept the rod 30 therethrough with slight clearance, thereby allowing the holders 36 to both slide and rotate on the rod 30. A set screw 42 extends into the mounting block 38 for tightening to engage the rod 30 when the proper position for the holder 36 is determined. Further, the mounting of the posts 34 to the frame 32 can be with bolts extending though oversize holes so that slight pivoting of the posts 34 is possible.

With the inventive guide assembly in place, the rollers 37 contact the finished surface of the partially formed gutter 10. It is understood that the holders 36 had previously been positionally adjusted so that the cylindrical surface of each roller 37 tangentially contacts the finished outside surface of the partially formed gutter 10. Since the guide rollers 37 rotate, the finished gutter surface does not slide across the guide rollers, so there is no scratching of the finished surface.

Accordingly, there has been disclosed a guide assembly which is protective of the finish on the face of a rain gutter being formed in a roll forming machine. While an illustrative embodiment of the present invention has been disclosed herein, it will be appreciated that various adaptations and modifications to the disclosed embodiment are possible without departing from the spirit and scope of the invention. Thus, for example, while cylindrical rollers have been disclosed, other shapes of rollers, such as spherical or conical, are possible. It is therefore intended that this invention be limited only by the scope of the appended claims.

What is claimed is:

1. In a roll forming machine of the type which forms an indeterminate length panel having a desired lateral profile from a uniform width supply strip of sheet metal having a pair of parallel straight edges, wherein said roll forming machine drives said supply strip along a predetermined path of travel through a plurality of roll forming stations, and wherein said supply strip has a first side which is finished to provide an aesthetically pleasing appearance, an assembly for contacting said finished first side of said supply strip to guide a partially formed portion of the panel along a portion of said predetermined path of travel without marring said finished first side, the assembly comprising:

an elongated rod mounted to a frame of said machine and extending substantially parallel to said portion of said predetermined path of travel;

at least one holder mounted to said rod; and at least one roller each mounted to a respective one of said at least one holder for rotation about a respective axis orthogonal to said rod.

2. The assembly according to claim 1 wherein said at least one holder is rotatably mounted to said rod.

3. The assembly according to claim 1 wherein said at least one holder is slidably mounted to said rod.

4. The assembly according to claim 1 wherein said at least one roller has a cylindrical shape.

* * * * *